United States Patent [19]

Przezdziecki

[11] Patent Number: 4,942,115

[45] Date of Patent: Jul. 17, 1990

[54] THERMALLY PROCESSABLE IMAGING ELEMENT COMPRISING AN OVERCOAT LAYER

[75] Inventor: Wojciech M. Przezdziecki, Pittsford, N.Y.

[73] Assignee: Eastman Kodak Company, Rochester, N.Y.

[21] Appl. No.: 342,154

[22] Filed: Apr. 24, 1989

[51] Int. Cl.[5] ..... G03C 1/76

[52] U.S. Cl. ..... 430/523; 430/523; 430/536; 430/617; 430/619; 430/950; 430/961

[58] Field of Search ..... 430/523, 617, 619, 950, 430/961, 536, 272

[56] References Cited

U.S. PATENT DOCUMENTS

| | | | |
|---|---|---|---|
| 3,080,254 | 3/1963 | Grand, Jr. | 430/346 |
| 3,271,345 | 9/1966 | Nadeau et al. . | |
| 3,437,484 | 4/1969 | Nadeau et al. . | |
| 3,457,075 | 7/1969 | Morgan et al. | 430/353 |
| 3,801,321 | 4/1974 | Evans et al. . | |
| 3,933,508 | 1/1976 | Ohkubo et al. | 430/523 |
| 4,264,725 | 4/1981 | Reeves | 430/619 |
| 4,459,350 | 7/1984 | Przezdziecki | 430/353 |
| 4,741,992 | 5/1988 | Przezdziecki | 430/523 |

OTHER PUBLICATIONS

Research Disclosure, Jun. 1978, Item No. 17029, *Research Disclosure,* Kenneth Mason Publications Ltd., Hampshire, England.

Research Disclosure, Mar. 1989, Item No. 29963, *Research Disclosure,* Kenneth Mason Publications, Ltd., Hampshire, England.

*Primary Examiner*—Jack P. Brammer

*Attorney, Agent, or Firm*—Richard E. Knapp

[57] ABSTRACT

A thermally processable imaging element having a hydrophobic imaging layer, an adhesion promoting polymer layer and an overcoat layer comprising poly(silicic acid) provides improved adhesion of the overcoat layer during thermal processing. The adhesion promoting layer comprises a terpolymer that promotes adhesion between the hydrophobic imaging layer and the overcoat layer without adversely affecting sensitometric properties of the imaging element. The adhesion promoting layer is useful in photothermographic and thermographic elements and processes.

7 Claims, No Drawings

THERMALLY PROCESSABLE IMAGING ELEMENT COMPRISING AN OVERCOAT LAYER

This invention relates to a thermally processable imaging element comprising a hydrophobic imaging layer and a hydrophilic overcoat layer with an adhesion promoting layer between the imaging layer and the overcoat layer that promotes adhesion of the overcoat layer without adversely affecting sensitometric properties of the imaging element.

Thermally processable imaging elements, including films and papers, for producing images by thermal processing are known. These elements include photothermographic elements in which an image is formed by imagewise exposure to light followed by development by uniformly heating the element. These elements also include thermograpbic elements in which an image is formed by imagewise heating the element. Such elements are described in, for example, *Research Disclosure,* June 1978, Item No. 17029; U.S. Pat. Nos. 3,457,075; 3,933,508; 3,080,254 and 4,741,992.

Overcoat layers have been useful on the thermally processable imaging elements to prevent undesired marking of the element during processing and hinder or prevent release of volatile components from the element at processing temperatures. An example of such an overcoat is a gelatin overcoat. A gelatin overcoat has not been effective to prevent migration of volatile components, such as succinimide, during long storage and at higher humidity during thermal processing.

An example of an effective overcoat is described in U.S. Pat. No. 4,741,992. Such an overcoat comprises poly(silicic acid), particularly poly (silicic acid) in combination with a hydrophilic monomer or polymer, such as poly(vinyl alcohol). This overcoat however has not been entirely satisfactory when the thermally processable imaging element comprises an imaging layer that is hydrophobic, such an imaging layer comprising a poly(-vinyl butyral) binder. It has been desirable to increase the degree of adhesion of such an overcoat to a imaging layer, particularly an imaging layer that is hydrophobic, to reduce the tendency or prevent the overcoat layer from being removed or being distorted during thermal processing. None of the above art suggests an answer that meets the requirements of such a thermally imaging element, particularly without adversely affecting the sensitometric properties of the element.

Polymers that have been considered to provide improved adhesion to layers on a support have not satisfied the requirements of a thermally processable imaging element because the polymers either have not provided the required degree of adhesion or have provided such adverse effects as poor barrier for volatile components, such as succinimide, during heat processing. Examples of such unsatisfactory polymers are poly(vinyl alcohols) such as disclosed in U.S. Pat. No. 4,741,992.

It has been found that the described requirements are satisfied by a thermally processable imaging element comprising a support bearing a thermally processable hydrophobic imaging layer and, on the side of the imaging layer away from the support, an overcoat layer comprising poly(silicic acid) and a hydrophilic monomer or polymer, wherein the element comprises a polymeric adhesion promoting layer between the overcoat and the imaging layer. The polymeric adhesion promoting layer comprises a polymer that not only adheres well to the hydrophobic imaging layer but also adheres well to the hydrophilic overcoat layer.

Such polymers that are useful in the polymeric adhesion promoting layer are:

(1) terpolymers of 2-propenenitrile, 1,1-dichloroethene, and propenoic acid, such as disclosed in U.S. Pat. No. 3,271,345; and (2) terpolymers of 2-propenoic acid, methyl ester, 1,1-dichloroethene and itaconic acid as disclosed in, for example, U.S. Pat. No. 3,437,484.

Combinations of such polymers in the polymeric adhesion promoting layer are also useful.

Such polymers are represented by the formulas:

$$[CH_2{=}CH{-}CN]_x\,[CH_2{=}CCl_2]_y\,[CH_2{=}CH{-}COOH]_z \quad (1)$$

and $$[CH_2{=}CH{-}CO{-}OCH_3]_q\,[CH_2{=}CCl_2]_r\,[CH_2{=}C(COOH){-}CH_2COOH]_s \quad (2)$$

wherein x, y, z, q, r and s are individually integers that enable a molecular weight of polymer that forms a coatable composition.

These polymers can be prepared by methods known in the polymer synthesis art. For example, terpolymers of 2-propenenitrile, 1,1-dichloroethene and propenoic acid are prepared by copolymerizing the respective monomers by polymerization methods known in the polymer art. These methods include known emulsion and solution polymerization methods.

A useful polymeric adhesion promoting layer composition as coated on the imaging layer does not adversely flow, smear or distort at processing temperatures of the element, typically within the range of 100° C. to 200° C.

The optimum concentration of adhesion promoting polymer in the polymeric adhesion promoting layer will depend upon such factors as the particular components of the adhesion promoting layer, the particular adhesion promoting polymer, the particular thermally processable element, and processing conditions. Typically the concentration of adhesion promoting polymer is present in the polymeric adhesion promoting layer within the range of 30 to 99% by weight of the layer. A preferred concentration of adhesion promoting polymer is within the range of 60 to 99% by weight of the layer.

A useful polymeric adhesion promoting layer is typically transparent and colorless. The overcoat layer on the adhesion promoting layer is also typically transparent and colorless. If these layers are not transparent and colorless, then it is necessary, if the element is a photothermographic element, that the layers be at least transparent to the wavelength of radiation employed to provide and view the image. The polymeric adhesion promoting layer and the overcoat do not significantly adversely effect the imaging properties, such as the sensitometric properties of the photothermographic element.

Other components, particularly other polymers, can be useful in the polymeric adhesion promoting layer and/or the overcoat layer. Other components that can be useful in one or the other or both of these layers include such other polymers as water soluble hydroxyl containing polymers, preferably poly(vinyl alcohol), or monomers that are compatible with the polymers of these layers. Other components that can be present in these layers include, for example, surfactants, stabilizers and matting agents.

Imaging elements, particularly photothermographic or thermographic elements, as described can comprise, if desired, multiple overcoat layers and/or multiple polymeric adhesion promoting layers. For example, the imaging element can comprise on the imaging layer a first polymeric adhesion promoting layer, a first overcoat comprising, for example, a water soluble cellulose derivative, such as cellulose acetate, and a second overcoat comprising poly(silicic acid) and poly(vinyl alcohol).

The polymeric adhesion promoting layer is useful on any thermally processable imaging element, particularly any photothermographic or thermographic element that has an imaging layer with which the polymeric adhesion promoting layer is compatible. The thermally processable imaging element can be a black and white imaging element or a dye forming thermally processable imaging element. The polymeric adhesion promoting layer is particularly useful on an imaging layer of a photothermographic element designed for dry physical development. Useful silver halide elements on which the polymeric adhesion promoting layer is useful are described in, for example, U.S. Pat. Nos. 3,457,075; 4,459,350; 4,264,725; and *Research Disclosure,* June 1978, Item No. 17029. The polymeric adhesion promoting layer is particularly useful on, for example, a photothermographic element comprising a support bearing, in reactive association, in a binder, particularly a poly(vinyl butyral) binder, (a) photographic silver halide, prepared in situ and/or ex situ, (b) an image forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent, such as succinimide. The photothermographic element preferably has directly on the polymeric adhesion promoting layer an overcoat layer, preferably an overcoat layer comprising 50 to 90% by weight of the overcoat layer of poly(silicic acid) and 1 to 50% by weight of the overcoat layer of poly(vinyl alcohol).

A particularly preferred embodiment is a photothermographic element comprising a support bearing, in reactive association, in a binder, particularly a poly(vinyl butyral) binder, (a) photographic silver halide, prepared in situ and/or ex situ, (b) an image forming combination comprising (i) silver behenate, with (ii) a phenolic reducing agent for the silver behenate, (c) a toning agent, such as succinimide, and an image stabilizer, such as 2-bromo-2-(4-methylphenylsulfony)acetamide; and having thereon a polymeric adhesion promoting layer comprising at least 30% by weight of the adhesion promoting layer of poly(2-propenenitrile-co-1,1-dichloroethene-co-2-propenoic acid) and having on the polymeric adhesion promoting layer an overcoat layer comprising 50 to 90% by weight of the overcoat layer of poly(silicic acid) and 1 to 50% by weight of the overcoat layer of poly(vinyl alcohol), particularly water soluble poly(vinyl alcohol) that is 80 to 90% hydrolyzed.

The optimum polymeric adhesion promoting layer thickness and the optimum overcoat layer thickness depend upon various factors, such as the particular element, processing conditions, thermal processing means, desired image and the particular components of the layers. A particularly useful layer thickness of the polymeric adhesion promoting layer is within the range of 0.04 to 2.0 microns, preferably within the range of 1.0 to 0.05 microns. A particularly useful layer thickness of the overcoat is within the range of 0.5 to 5.0 microns, preferably within the range of 1.0 to 2.0 microns.

The photothermographic element comprises a photosensitive component that consists essentially of photographic silver halide. A preferred concentration of photographic silver halide is within the range of 0.01 to 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain silver halides are especially useful. The photographic silver halide can be prepared by any of the procedures known in the photographic art. Such procedures for forming photographic silver halide and the forms of silver halide are described in, for example, *Research Disclosure.* June 1978, Item 17029 and *Research Disclosure.* December 1978, Item No. 17643. Tabular grain photographic silver halide is also useful, as described in, for example, U.S. Pat. No. 4,435,499. The photographic silver halide can be washed or unwashed, chemically sensitized, protected against the production of fog and stabilized against the loss of sensitivity during keeping as described in the above Research Disclosure publications. The silver halides can be prepared in situ, such as described in U.S Pat. No. 3,457,075, or prepared ex situ by procedures known in the photographic art.

The photothermographic element typically comprises an oxidation-reduction imaging forming combination that contains an organic silver salt oxidizing agent, preferably a silver salt of a long chain fatty acid. Such a silver salt of a long chain fatty acid is resistant to darkening upon illumination. Preferred organic silver salt oxidizing agents are silver salts of long chain fatty acids that contain 10 to 30 carbon atoms. Examples of such organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents that are not silver salts of long chain fatty acids include, for example, silver benzoate and silver benzotriazole.

The optimum concentration of organic silver salt oxidizing agent in a photothermographic element will vary depending upon the desired image, particular silver salt oxidizing agent, particular reducing agent, and particular photothermographic element. A preferred concentration of silver salt oxidizing agent is within the range of 0.4 to 100 moles of organic silver salt oxidizing agent per mole of silver. When combinations of organic silver salt oxidizing agent are present, the total concentration of organic silver salt oxidizing agent is preferably within the described concentration range.

A variety of reducing agents are useful in the photothermographic element. Examples of useful reducing agents include substituted phenols and naphthols such as bis-beta-naphthols; polyhydroxybenzenes, such as hydroquinones, catechols and pyrogallols; aminophenols, such as 2,4-diaminophenols and methylaminophenols; ascorbic acid reducing agents, such as ascorbic acid, ascorbic acid ketals, and other ascorbic acid derivatives; hydroxylamine reducing agents; 3-pyrazolidone reducing agents, such as 1-phenyl-3-pyrazolidone, and 4-methyl-4-hydroxymethyl-3-pyrazolidone; sulfonamidophenols and other organic reducing agents as described in, for example, U.S. Pat. No. 3,933,508 and *Research Disclosure,* June 1978, Item No. 17029. Combinations of organic reducing agents are also useful.

Preferred organic reducing agents in photothermographic elements as described are sulfonamidophenol reducing agents, such as described in U.S. Pat. No. 3,801,321. Examples of useful sulfonamidophenols include 2,6-dichloro-4-benzenesulfonamidophenol; benzenesulfonamidophenol; 2,6-dibromo-4-benzenesulfonamidophenol and mixtures of such sulfonamidophenols.

An optimum concentration of reducing agent in a photothermographic element as described varies depending upon such factors as the particular photothermographic element, desired image, processing conditions, the particular silver salt oxidizing agent and other addenda in the element. A preferred concentration of reducing agent is within the range of about 0.2 mole to about 2.0 moles of reducing agent per mole of silver in the photothermographic element. When combinations of reducing agents are present, the total concentration of reducing agent is preferably within the described range.

The photothermographic element preferably comprises a toning agent, also known as an activator-toner or a toner-accelerator. Combinations of toning agents are also useful in the photothermographic element. An optimum toning agent or combination of toning agents depends upon such factors as the particular photothermographic element, desired image, particular components in the imaging material, and processing conditions. Examples of useful toning agents include phthalimide, N-hydroxyphthalimide, N-potassium phthalimide, succinimide, N-hydroxy-1,8-naphthalimide, phthalazine, 1-(2H)-phthalazinone, and 2-acetylphthalazinone.

Stabilizers that are useful in photothermographic elements include photolytically active stabilizers and stabilizer precursors as described in, for example, U.S. Pat. No. 4,459,350 and include, for example, azole thioethers and blocked azolinethione stabilizers and carbamoyl stabilizer precursors such as described in U.S Pat. 3,877,940.

Photothermographic materials as described preferably contain various colloids and polymers alone or in combination as vehicles and binding agents and in various layers. Useful vehicles and binding agents are hydrophilic or hydrophobic. They are transparent or translucent and include naturally occurring substances, such as gelatin, gelatin derivatives, polysaccharides, such as dextran, gum arabic, cellulose derivatives and the like; and synthetic polymeric substances such as water-soluble polyvinyl compounds, for example poly(vinylpyrrolidone) and acrylamide polymers. Other synthetic polymeric compounds that are useful include dispersed vinyl compounds such as in latex form and particularly those that increase dimensional stability of photographic materials. Effective polymers include water insoluble polymers of alkylacrylates and methacrylates, acrylic acid, sulfoalkylacrylates and those that have cross-linking sites that facilitate hardening or curing. Preferred high molecular weight materials and resins that are useful as binders and vehicles include poly(vinyl butyral), cellulose acetate, poly(methylmethacrylate), poly(vinylpyrrolidone), ethyl cellulose, polystyrene, poly(vinylchloride), chlorinated rubbers, polyisobutylene, butadienestyrene copolymers, vinyl chloride-vinyl acetate copolymers, copolymers of vinyl acetate and vinylidene chloride, poly(vinyl alcohol), and carbonates.

Photothermographic materials can contain development modifiers that function as speed increasing compounds, sensitizing dyes, hardeners, antistatic layers, plasticizers and lubricants, coating aids, brighteners, absorbing and filter dyes, such as described in *Research Disclosure,* December 1978, Item No. 17643 and *Research Disclosure,* June 1978, Item No. 17029.

The thermally processable elements comprise a variety of supports. Examples of useful supports include poly(vinylacetal) film, polystyrene film, poly(ethyleneterephthalate) film, polycarbonate film and related films and resinous materials as well as glass, paper, metal and other supports that can withstand the thermal processing temperatures.

The layers, including the imaging layers, the adhesion promoting layer, and overcoat layers, of a thermally processable element as described can be coated on the support by coating procedures known in the photographic art, including dip coating, air knife coating, curtain coating or extrusion coating using hoppers. If desired, two pr more layers are coated simultaneously.

Spectral sensitizing dyes are useful in the described photothermographic materials to confer added sensitivity to the elements and compositions. Useful sensitizing dyes are described in, for example, the above *Research Disclosure* publications.

A photothermographic material preferably comprises a thermal stabilizer to help stabilize the photothermographic material prior to exposure and processing. Such a thermal stabilizer aids improvement of stability of the photothermographic material during storage. Preferred thermal stabilizers are (a) 2-bromo2-arylsulfonylacetamides, such as 2-bromo-2-p-tolysulfonylacetamide, (b) 2-(tribromomethylsulfonyl)benzothiazole and (c) 6-substituted-2,4-bis(tribromomethyl)-s-triazine, such as 6-methyl or 6-phenyl2,4-bis(tribromomethyl)-s-triazine.

The thermally processable elements are exposed by means of various forms of energy in the case of silver halide photothermographic elements. Such forms of energy include those to which the photosensitive silver halide is sensitive and include the ultraviolet, visible, and infrared regions of the electromagnetic spectrum as well as electron beam and beta radiation, gamma ray, x-ray, alpha particle, neutron radiation and other forms of corpuscular wave-like radiant energy in either noncoherent (random-phase) or coherent (in-phase) forms as produced by lasers. Exposures are monochromatic, orthochromatic or panchromatic depending upon the spectral sensitization of the photographic silver halide. Imagewise exposure is preferably for a time and intensity sufficient to produce a developable latent image in the photothermographic material. After imagewise exposure of the photothermographic material, the resulting latent image is developed merely by overall heating the element at moderately elevated temperatures. This overall heating merely involves heating the element to a temperature within the range of about 90° C. to 150° C. until a developed image is produced, such as within about 0.5 to about 60 seconds. By increasing or decreasing the thermal processing temperature a shorter or longer processing time is useful depending upon the desired image, the particular components in the photothermographic material and the heating means. A preferred processing temperature is within the range of about 100° C. to about 130° C.

In the case of thermographic elements the thermal energy source and means for imaging purposes can be any imagewise thermal exposure source and means that are known in the thermographic art. The imagewise heating means can be, for example, an infrared heating means, laser, microwave heating means or the like.

Heating means known in the photothermographic and thermographic art can be used for providing the desired thermal processing temperature range for processing the photothermographic element. The heating means can be, for example, a simple hot plate, iron, roller, heated drum, microwave heating means, or heated air.

Thermal processing is preferably carried out under ambient conditions of pressure and humidity. Conditions outside normal atmospheric pressure and humidity are useful if desired.

The components of the thermally processable element can be in any location in the element that provides the desired image. If desired, one or more of the components of the photothermographic element can be in on or more layers of the element. For example, in some cases, it is desirable to include certain percentages of the reducing agent, toner, stabilizer precursor and/or other addenda in the adhesion promoting layer and/or in the overcoat layer of the photothermographic element.

It is necessary that the component of the imaging combination be "in association" with each other in order to produce the desired image. The term "in association" herein means that in the photothermographic element the photosensitive silver halide and the image forming combination are in a location with respect to each other that enables the desired processing and produces a useful image.

Thermographic elements on which the adhesion promoting layer and the overcoat layer are useful include any that are compatible with the polymer that comprises the adhesion promoting layer. Such photothermographic elements include those described in, for example, U.S. Pat. Nos. 2,663,657; 2,910,377; 3,028,254; 3,031,329 and 3,080,254. An example of a useful thermographic element comprises a support bearing a thermographic imaging layer having thereon an adhesion promoting layer as described and thereon an overcoat layer, also as described.

The term water soluble herein means at least 2 grams of the compound or composition dissolves in one liter of water within 2 hours at 90° C.

The following examples further illustrate the invention.

EXAMPLE 1:

This illustrates use of poly(2-propenenitrile-co-1,1-dichloroethene-co-2-propenoic acid) designated herein as Terpolymer No. 1 in an adhesion promoting polymer layer in a photothermographic element between a hydrophobic imaging layer and an overcoat layer.

A photothermographic element was prepared having the following photothermographic layer on a blue poly(ethylene terephthalate) film support:

| I Photothermographic Emulsion Layer (designated herein as the E-layer): | mg/ft$^2$ |
|---|---|
| Photothermographic Layer | |
| Silver Behenate (Ag) | 80.0 |
| $HgBr_2$ (Hg) | 0.1 |
| AgBr (Ag) | 40.0 |

-continued

| I Photothermographic Emulsion Layer (designated herein as the E-layer): | mg/ft$^2$ |
|---|---|
| NaI | 3.5 |
| Succinimide toner/development modifier | 42.0 |
| Surfactant (SF-96 which is a polysiloxane fluid and is available from and a trademark of General Electric Co., U.S.A.) | 1.5 |
| Monobromo stabilizer: | 6.0 |

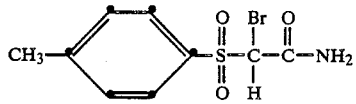

| | |
|---|---|
| Naphthyltriazine stabilizer: | 6.0 |

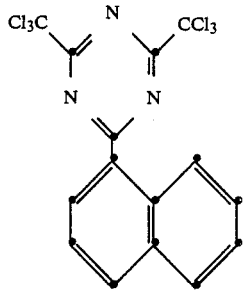

| | |
|---|---|
| Poly(vinyl butyral) binder (Butvar B-76 a trademark of the Monsanto Co., U.S.A.) | 400.0 |
| Sensitizing dye | 0.5 |
| Benzenesulfonamidophenol developing agent: | 100.00 |

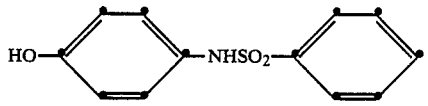

| | |
|---|---|
| MIBK solvent | 30.0 |

The following layers were coated on the E-Layer as described in following Part A and Part B:

| II. Overcoat #1 - Gelatin | |
|---|---|
| Photographic gelatin | 161.0 |
| Matte | 10.0 |
| Formaldehyde | 4.2 |
| Surfactant (Surfactant 10 G which is p-isononylphenoxypolyglycidol, a trademark of and available from the Olin Corp., U. S. A.) | 4.7 |

| III. Overcoat #2 - Poly(silicic acid) (PSA)/ Poly(vinyl alcohol) (PVA) | mg/ft$^2$ |
|---|---|
| Ratio $\frac{Si(OH)4}{PVA}$ = | 1.25 |
| 8% PVA, Elvanol 52/22 | 125.0 g |
| Distilled Water | 48.5 g |
| PSA solution | 76.5 g |
| TOTAL | 250.0 g |

Solution of Poly(vinyl alcohol)(PVA)

An aqueous solution of 8% by weight poly(vinyl alcohol) in water was prepared. (8% by weight EL- VANOL52/22 in water. ELVANOL 52/22 is a trademark of E. I. duPont DeNemours, U.S.A.)

Solution of Poly(silicic acic)(PSA)

Hydrolysis of tetraethyl orthosilicate (TEOS) to form poly(silicic acid)(PSA)

The following components were mixed in the following order:

| | |
|---|---|
| Distilled Water | 144 g |
| 1N-p-Toluenesulfonic Acid | 36 g |
| Ethyl Alcohol | 200 g |
| TEOS | 208 g |

A clear solution of PSA was obtained in less than 10 minutes.

| IV. Adhesion Promoting Layer | |
|---|---|
| Adhesion Promoting Layer #1: | |
| Terpolymer #1 (30% Latex) | 1 part |
| Distilled Water | 9 parts |
| Surfactant (Surfactant 10 G) | 1 drop |
| Adhesion Promoting Layer #2 | |
| (Terpolymer #1 with PVA) | |
| Terpolymer #1 Latex (30% solids) | 10 g |
| 2% PVA solution | 90 g |
| Olin 10 G Surfactant | 1 drop |

PVA = Poly(vinyl alcohol), ELVANOL 52/22

Part A: Adhesion Promoting Layer to Improve Overcoat Adhesion

Photothermographic films were prepared by preparing structures A (Comparison) and B (Invention):

| A (Comparison) | B (Invention) |
|---|---|
| PSA/PVA (Overcoat #2) | PSA/PVA (Overcoat #2) |
| E-Layer | Adhesion Layer* |
| Film Support | E-Layer |
| | Film Support |

The adhesion promoting layer in B was hand-coated at 2 mil wet laydown on top of the E-Layer and, after drying, overcoated with the PSA/PVA composition. Coatings A and B were tested for the overcoat adhesion using 3M-Scotch 600 Transparent Tape. Overcoat is easily stripped off the structure A, but not from structure B, even when the overcoat is heavily scored prior to the tape test.

Tape test procedure: (a) Place approximately 2 inch strip of tape on top of the coating and smooth out to assure uniform adhesion to the test surface; (b) rip off the tape and inspect the surface. A more drastic test for the overcoat adhesion is when the overcoat is heavily scored prior to tape application.

Part B: Comparison of Adhesion Promoting Layers and Overcoats

A photothermographic film as described in Example 1 was prepared with an E-Layer (I) and was overcoated with either gelatin (II) or PSA/PVA overcoat (III). Selected coatings contained the compositions and the resulting adhesion tests are tabulated as follows:

| Adhesion Promoting Layer | Overcoat | Adhesion | | |
|---|---|---|---|---|
| | | Tape A | Tape B | Tape & Score |
| None (Control) | #2 PSA/PVA | + | − | |
| No. 1 (Terpolymer No. 1) | #2 PSA/PVA | + | + | − |
| No. 2 (Terpolymer No. 1 with PVA) | #2 PSA/PVA | + | + | + |
| None (Control) | #1 Gelatin | − | | |
| No. 1 (Terpolymer No. 1) | #1 Gelatin | + | + | + |
| No. 2 (Terpolymer No. 1 with PVA) | #1 Gelatin | −* | | |

*failure probably due to incompatibility of gelatin and the poly(vinyl alcohol) (PVA)
Tape A - 3M, Scotch Tape #810 (Trademar of 3M Co., U.S.A.)
Tape B - 3M, Transparent Tape #600
+ = pass
− = fail The above tabulated results are qualitative observations. These samples were also submitted for a standard quantitative adhesion evaluation. The results are tabulated as follows:

| Adhesive Peel Force Test | | |
|---|---|---|
| Adhesion Promoting Layer | Overcoat | Peel Force Grams/1.9 cm |
| None (Control) | #2 PSA/PVA | 8 |
| No. 1 (Terpolymer No. 1) | #2 PSA/PVA | 59 |
| No. 2 (Terpolymer No. 1 with PVA) | #2 PSA/PVA | >600 |
| None (Control) | #1 Gelatin | 11 |
| No. 1 (Terpolymer No. 1) | #1 Gelatin | >600 |
| No. 2 (Terpolymer No. 1 with PVA) | #1 Gelatin | 33 |

The above examples illustrate a surprising, significant increase in the adhesion of hydrophilic overcoats such as gelatin or PVA/PSA to a hydrophobic, particularly a photothermographic E-Layer as described.

The invention has been described in detail with particular reference to preferred embodiments thereof, but it will be understood that variations and modifications can be effected within the spirit and scope of the invention.

What is claimed is:

1. A thermally processable imaging element comprising a support bearing a thermally processable hydrophobic imaging layer and, on the side of the imaging layer away from the support, an overcoat layer comprising poly(silicic acid) and a hydrophilic monomer or polymer, wherein the element comprises a polymeric adhesion promoting layer between the overcoat and the imaging layer.

2. A thermally processable imaging element as in claim 1 that is a photothermographic silver halide element.

3. A thermally processable imaging element as in claim 1 wherein the polymeric adhesion promoting layer comprises poly(2-propenenitrile co-1,1 -dichloroethene-co-2-propenoic acid) or poly(2-propenoic acid, methyl-ester-co-1,1dichloroethene-co-itaconic acid).

4. A thermally processable imaging element as in claim 1 wherein the polymeric adhesion promoting layer comprises poly(2-propenenitrile-co-1,1-dichloroethene-co-2-propenoic acid) and poly(vinyl alcohol).

5. A thermally processable imaging element as in claim 1 wherein the imaging layer comprises a poly(vinyl butyral) binder.

6. A thermally processable imaging element comprising a support bearing a hydrophobic photothermographic imaging layer comprising a poly(vinyl butyral) binder, photographic silver halide and an oxidation-reduction image forming combination comprising an organic silver salt oxidizing agent with a phenolic reducing agent, having, directly on the imaging layer, an adhesion promoting layer comprising poly(2-propenenitrile-co-1,1-dichloroethene-co-propenoic acid), and having, directly on the adhesion promoting layer an overcoat layer comprising 50 to 90% poly(silicic acid) and 10 to 50% poly(vinyl alcohol).

7. A thermally processable imaging element as in claim 6 wherein the adhesion promoting layer also comprises poly(vinyl alcohol).

* * * * *